US007749040B2

(12) United States Patent
Grubba

(10) Patent No.: US 7,749,040 B2
(45) Date of Patent: Jul. 6, 2010

(54) SMOKE PRODUCTION SYSTEM FOR MODEL LOCOMOTIVE

(76) Inventor: Robert A. Grubba, 290 Golden Saddle Ln., Ormond Beach, FL (US) 32174

( * ) Notice: Subject to any disclaimer, the term of this patent is extended or adjusted under 35 U.S.C. 154(b) by 105 days.

(21) Appl. No.: 12/218,459

(22) Filed: Jul. 15, 2008

(65) Prior Publication Data

US 2010/0015880 A1 Jan. 21, 2010

(51) Int. Cl.
*A63H 19/14* (2006.01)

(52) U.S. Cl. ..... 446/25; 446/24; 446/467

(58) Field of Classification Search ..... 446/24, 446/25, 186, 467, 484; 105/1.5; 318/282, 318/286; 392/366, 395–398, 402–406
See application file for complete search history.

(56) References Cited

U.S. PATENT DOCUMENTS

| | | | | |
|---|---|---|---|---|
| 1,848,028 | A | 3/1932 | Richie | |
| 3,342,746 | A | 9/1967 | Seuthe | |
| 4,374,038 | A | 2/1983 | Tamura | |
| 5,334,071 | A * | 8/1994 | Mills | 446/186 |
| 6,106,356 | A * | 8/2000 | Trageser | 446/72 |
| 6,280,278 | B1 | 8/2001 | Wells | |
| 6,485,347 | B1 | 11/2002 | Grubba | |
| 6,676,473 | B2 | 1/2004 | Pierson | |
| 7,297,045 | B2 * | 11/2007 | Pierson et al. | 446/467 |
| 2004/0198135 | A1 * | 10/2004 | Pierson et al. | 446/25 |

* cited by examiner

*Primary Examiner*—Nini Legesse
(74) *Attorney, Agent, or Firm*—J. Wiley Horton

(57) ABSTRACT

A smoke production system for a model locomotive capable of accurately simulating the exhaust characteristics of an actual locomotive. The present invention accomplishes this by monitoring the rotation to the flywheel of the electric motor used to drive the drive wheels of the model locomotive. Various devices may be used to monitor the rotation of the flywheel. For example, a magnet is employed on the flywheel and a magnetically-reactive element such as a reed switch or Hall effect sensor is positioned adjacent to the flywheel. Alternatively, an opticoupler or cam may be used to track the rotations of the flywheel. A controller counts the rotations of the flywheel and actuates a smoke production device to emit smoke four discrete times for every rotation of the model locomotive's drive wheel.

14 Claims, 11 Drawing Sheets

SMOKE PRODUCTION SYSTEM FOR MODEL LOCOMOTIVE

CROSS-REFERENCES TO RELATED APPLICATIONS

Not Applicable.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of model trains. More specifically, the present invention comprises a smoke production system for a model locomotive.

2. Description of the Related Art

Model train hobbyists spend a great deal of time and effort in constructing model train systems which accurately simulate reality. For example, many hobbyists enjoy building railroad sets which recreate the environment and scenery of popular railways. Likewise, many hobbyists purchase or develop elaborate controllers or soundcards for replicating traditional sounds heard around a railway including whistles, steam chuffs, and brakes. Model locomotives and rail cars are also recreated in exacting detail.

A lesser amount of attention has been directed towards simulating the appearance of steam emitted from an operating locomotive. Actual steam-powered locomotives use steam pressure to drive reciprocating pistons. The reciprocating pistons turn drive wheels on the railroad track to propel the locomotive forward or rearward on the track. The reciprocating pistons are attached to the drive wheels through connecting rods and linkages. Those that are familiar with the operation of steam locomotives know that four discrete exhaust pulses are emitted from the locomotive for every revolution of the drive wheel. Prior art steam exhaust simulation devices do a very poor job at replicating this feature. As such, it would be beneficial to provide a smoke production system for a model locomotive capable of accurately simulating the exhaust characteristics of an actual locomotive.

BRIEF SUMMARY OF THE INVENTION

The present invention is a smoke production system for a model locomotive capable of accurately simulating the exhaust characteristics of an actual locomotive. The present invention accomplishes this by monitoring the rotation to the flywheel of the electric motor used to drive the drive wheels of the model locomotive. Various devices may be used to monitor the rotation of the flywheel. In the preferred embodiment, a magnet is employed on the flywheel and a magnetically-reactive element such as a reed switch or Hall effect sensor is positioned adjacent to the flywheel. Alternatively, an opticoupler or cam may be used to track the rotations of the flywheel. A controller counts the rotations of the flywheel and actuates a smoke production device to emit smoke four discrete times for every rotation of the model locomotive's drive wheel.

REFERENCE NUMERALS IN THE DRAWINGS

| | | | |
|---|---|---|---|
| 10 | model locomotive | 12 | motor |
| 14 | power transmission unit | 16 | worm gear |
| 18 | worm gear | 20 | spur gear |
| 22 | spur gear | 24 | smoke production device |
| 26 | conductor | 28 | drive shaft |
| 30 | power shaft | 32 | universal coupling joint |
| 34 | universal coupling joint | 36 | transmission |
| 38 | flywheel | 40 | magnet |
| 42 | reed switch | 44 | fixed contact |
| 46 | movable contact | 48 | heating element |
| 50 | smoking substance | 52 | fan motor |
| 54 | fan | 56 | stepper motor |
| 58 | shutter valve | 60 | smoke stack |
| 62 | smoke | 64 | drive wheel |
| 66 | support structure | 68 | reflective surface |
| 70 | nonreflective strips | 72 | light source |
| 74 | sensor | 76 | conductor |
| 78 | cam | 80 | switch |
| 82 | conductor | 84 | controller |
| 86 | comparator | 88 | reset command |
| 90 | power command | 92 | counter |

DETAILED DESCRIPTION OF THE INVENTION

Figure 1:
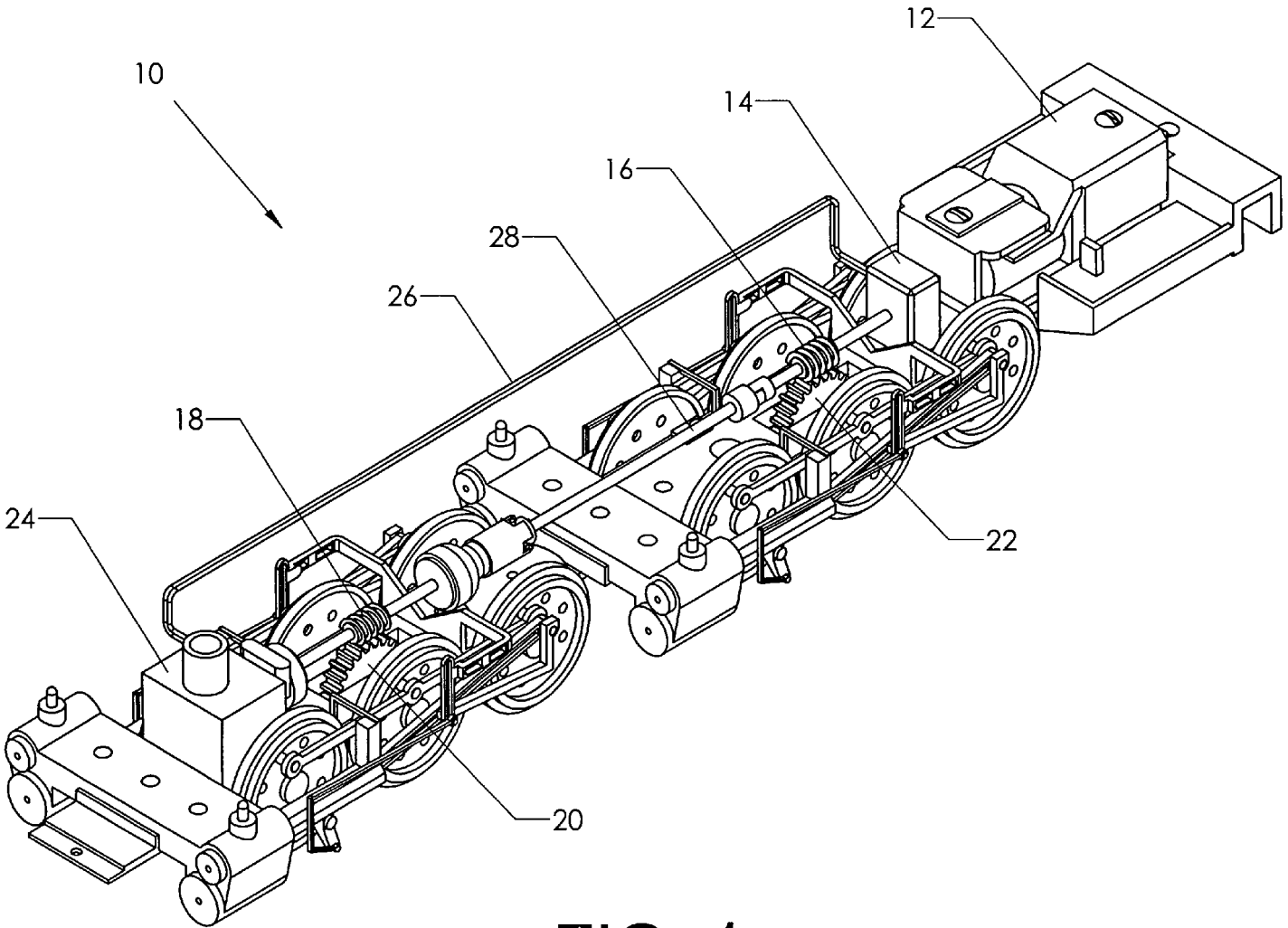
FIG. 1 is a perspective view, illustrating the present invention.

The present invention, a smoke production system for a model locomotive, is illustrated in FIG. 1. Model locomotive 10 includes motor 12. Motor 12 is a DC motor which is powered by a voltage supplied to the model railroad track by a power unit. The speed of motor 12 may be adjusted by changing the track voltage. The power shaft of motor 12 supplies mechanical power to power transmission unit 14. Power transmission unit 14 transfers the mechanical power to worm gears 16 and 18 which drive spur gears 22 and 20, respectively. Spur gear 22 turns drive wheel 64 which propels model locomotive 10 forward or rearward along the railroad track. Power transmission unit 14, worm gear 16, and spur gear 22, collectively act as a gear reduction to motor 12. The standard gear reduction for model locomotives is 22:1. In other words, drive wheel 64 rotates one time for every 22 rotations of motor 12. The direction of travel typically depends on the polarity of the track voltage. In most applications, the direction of travel may be reversed by reversing the polarity of the track voltage.

Model locomotive 10 also has smoke production device 24 for producing a "smoke effect." Smoke production device 24 is electrically connected to a controller (not illustrated here) and a sensor attached to power transmission unit 14 by conductor 26. It should be appreciated that these components may be provided to hobbyists independently of model locomotive 10 and sold as an "aftermarket" accessory.

Figure 2:
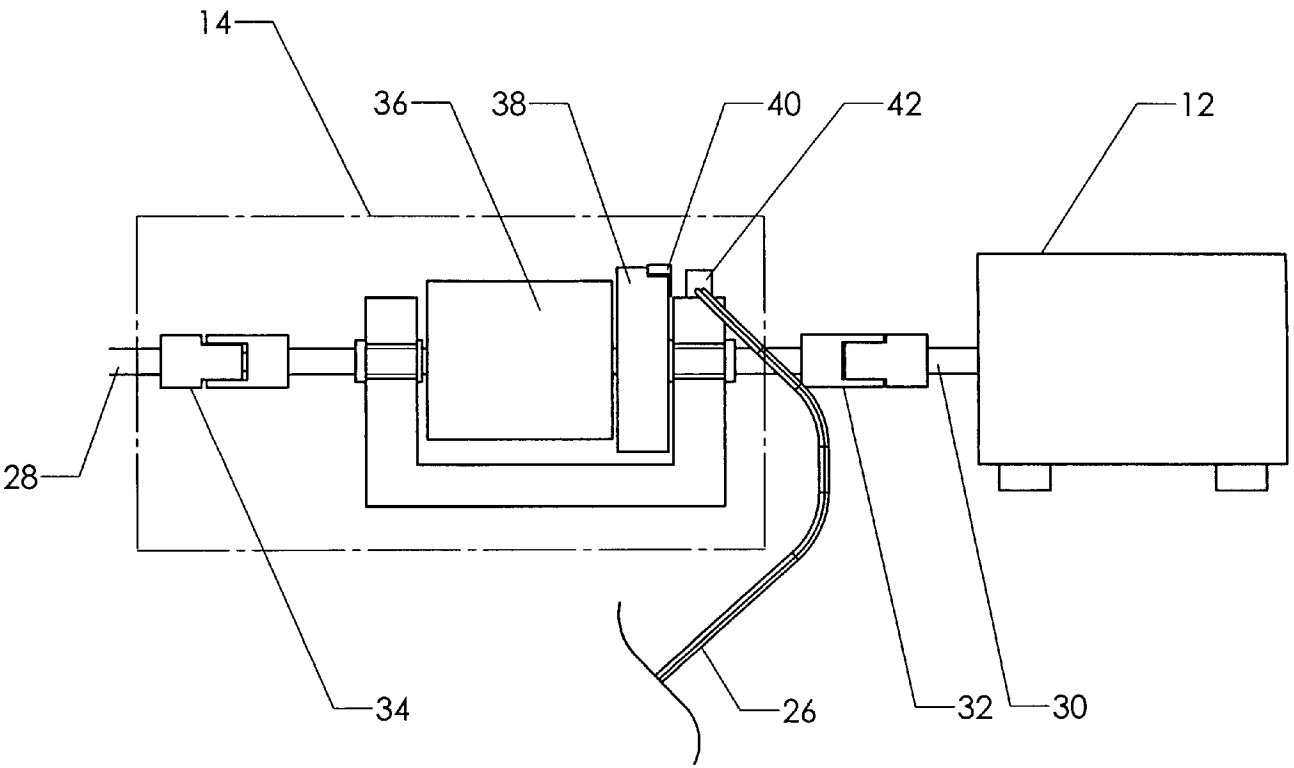
FIG. 2 is a plan view, illustrating components of the present invention.

Turning to FIG. 2, power transmission unit 14 is illustrated in greater detail. Power transmission unit 14 is mechanically linked to power shaft 30 of motor 12 via universal coupling joint 32. Flywheel 38 is linked to universal coupling joint 32 and rotates at the same speed as motor 12. Transmission 36 includes one or more reduction gears which reduce the rotational speed of drive shaft 28. Drive shaft 28 is linked to power transmission unit 14 via universal coupling joint 34. As shown in FIG. 1, drive shaft 28 rotates worm gears 16 and 18.

Support structure 66 supports and maintains the alignment of flywheel 38 and transmission 36 with power shaft 30 and drive shaft 28. A sensor (in this example, reed switch 42) is attached to support structure 66 adjacent to flywheel 38. Magnet 40 is attached to flywheel 38 near the perimeter in one sector. Reed switch is electrically connected with a controller via conductor 26.

Figure 3A:
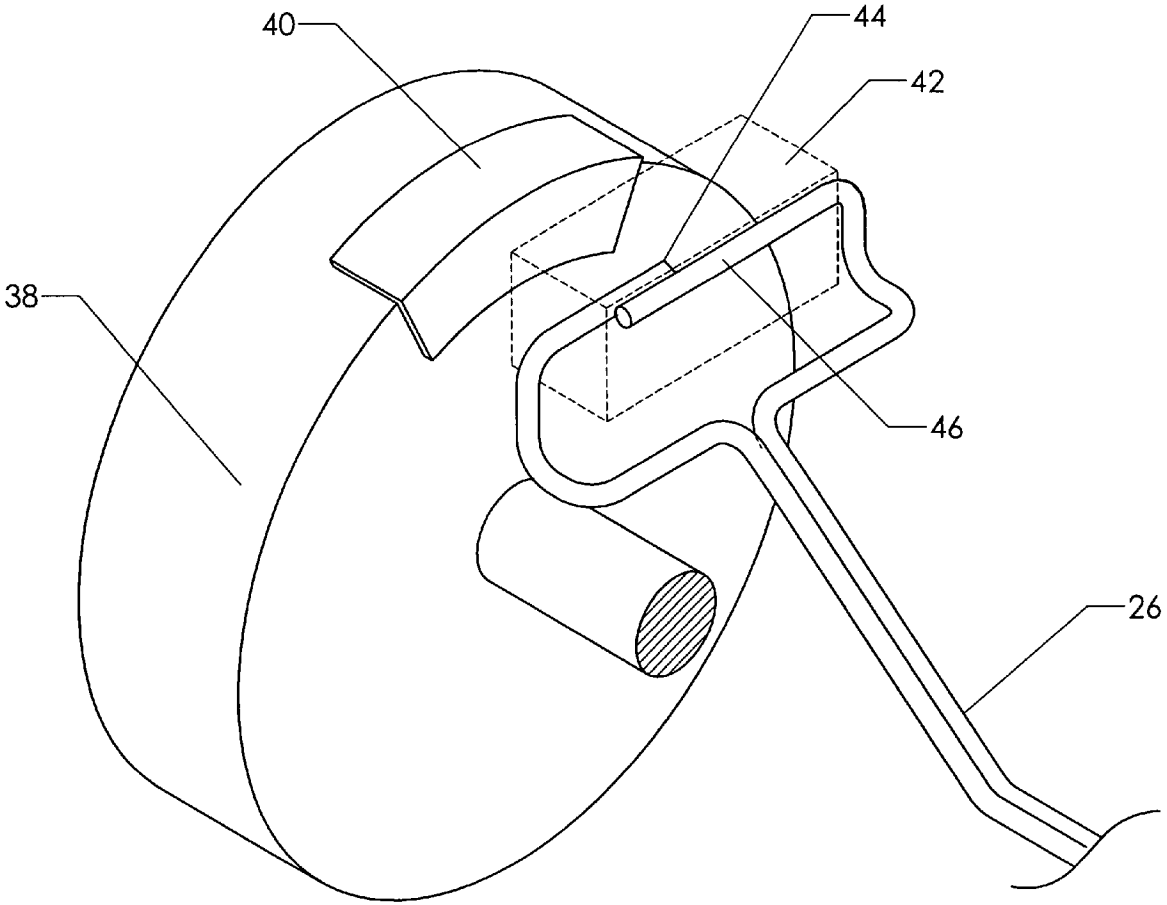
FIG. 3A is a detail view, illustrating components of the present invention.

Turning to FIG. 3A, the reader will note that reed switch 42 includes magnetically-reactive, movable contact 46 and nonreactive, fixed contact 44. When flywheel 38 rotates, magnet 40 repeatedly moves in and out of proximity with respect to reed switch 42. When flywheel 38 is in the position shown in FIG. 3A, the magnetic field produced by magnet 40 causes movable contact 46 to deflect into fixed contact 44, closing the switch on conductor 26.

Figure 3B:
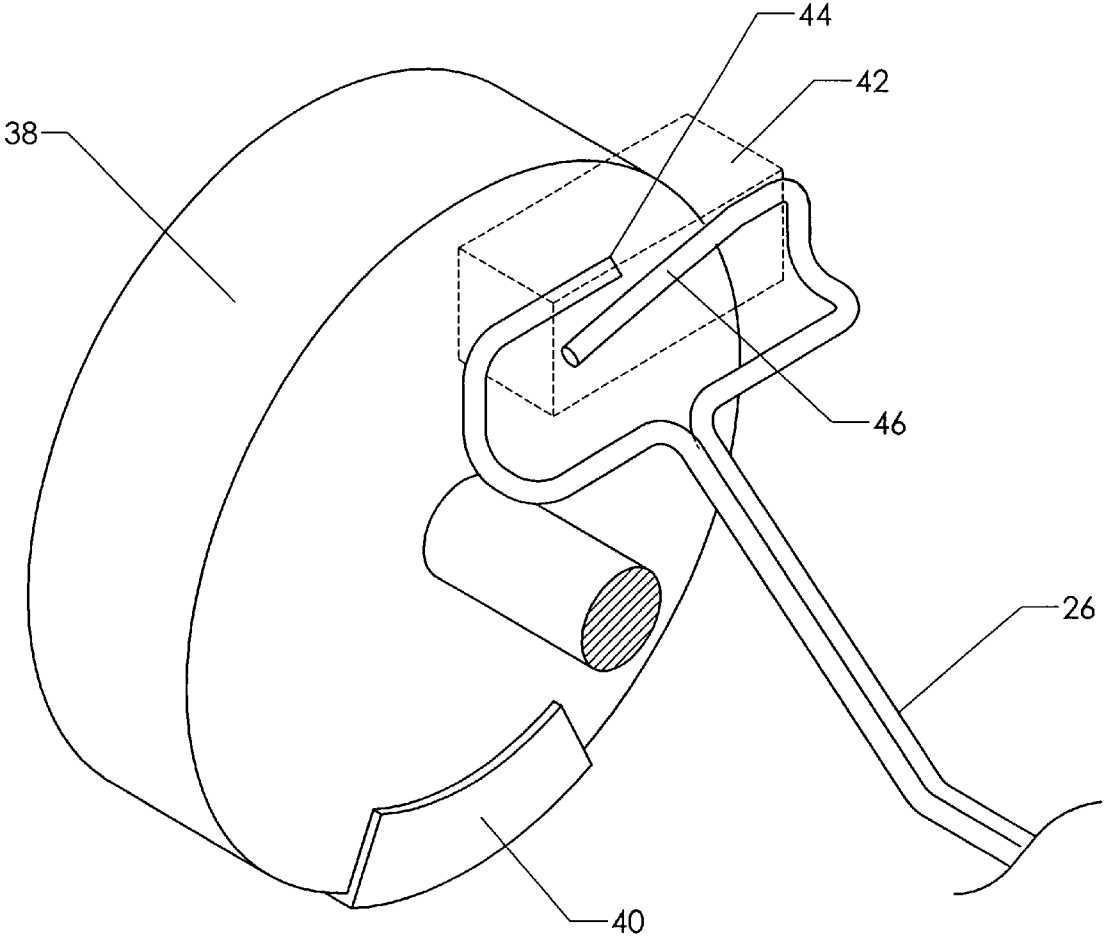
FIG. 3B is a detail view, illustrating components of the present invention.

Turning to FIG. 3B, flywheel 38 is shown exactly one-half of a rotation (180 degrees) out of phase with the position depicted in FIG. 3A. In this position, reed switch 42 is not affected by magnet 40 and movable contact 46 returns to its normal, undeflected position. This creates an open circuit condition on conductor 26.

Although, reed switch 42 is illustrated in FIGS. 3A and 3B, other magnetically reactive elements may be used in place of reed switch 42. For example, a Hall effect sensor may be attached to support structure 66 in place of reed switch 42. Those that are skilled in the art know that a Hall effect sensor is a solid state transducer which varies its output voltage based on its proximity to a magnetic field.

Figure 5:
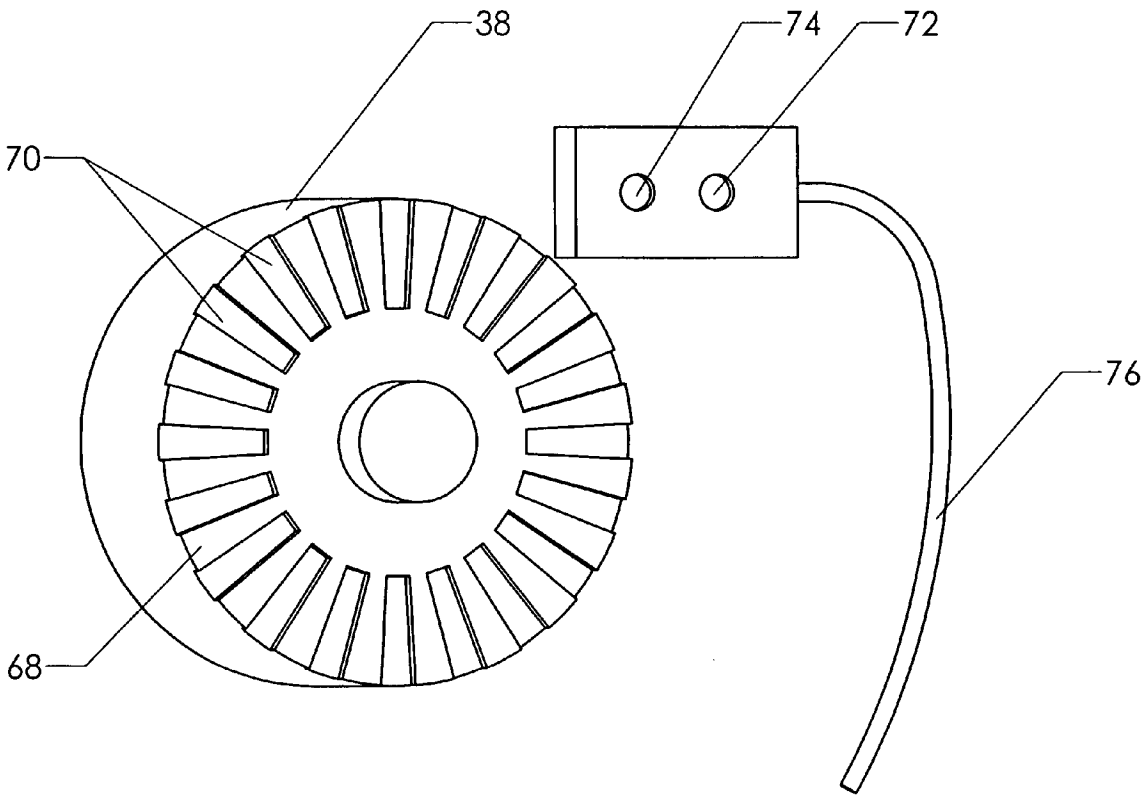
FIG. 5 is a detail view, illustrating components of the present invention.

Alternatively, other devices may be used to sense the rotation of flywheel 38 in place of reed switch 42. For example, as shown in FIG. 5, an opticoupler type photo sensor may be used. Those that are skilled in the art know that an opticoupler uses a light emitter and sensor to detect variations in light reflection on a moving surface. When employed on flywheel 38, the rate of change of these variations corresponds to the rotational speed of flywheel 38. In the embodiment illustrated in FIG. 5, flywheel 38 has reflective surface 68. Nonreflective strips 70 are provide angularly near the perimeter of flywheel 38. The opticoupler includes light source 72 which emits light against flywheel 38 near its perimeter. Sensor 74 detects light reflecting off of flywheel 38. Thus, the opticoupler will detect the movement of flywheel 38 as nonreflective strips 70 pass through the focused light beam emitted by light source 72. The opticoupler transmits a signal to the controller via conductor 76 when a change in reflectivity is detected. The controller can easily compute rotational speed or the quantity of rotations since the number of nonreflective strips 70 is known.

Figure 6A:
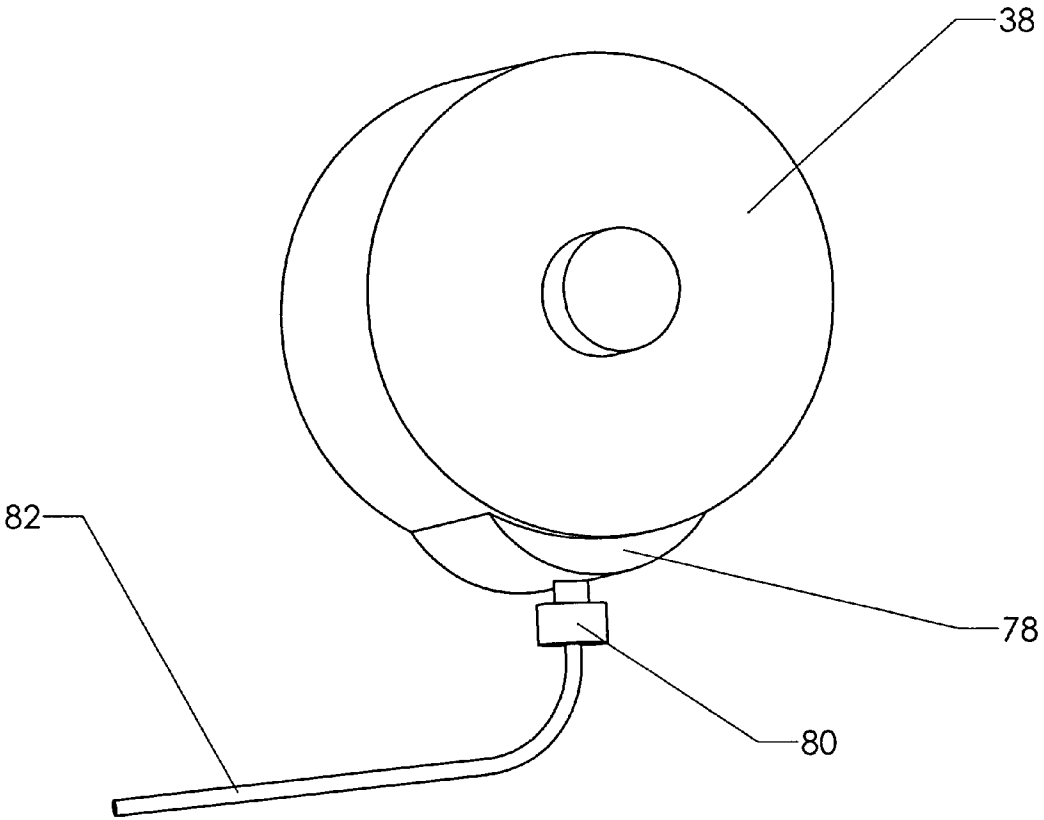
FIG. 6A is a detail view, illustrating components of the present invention.
Figure 6B:
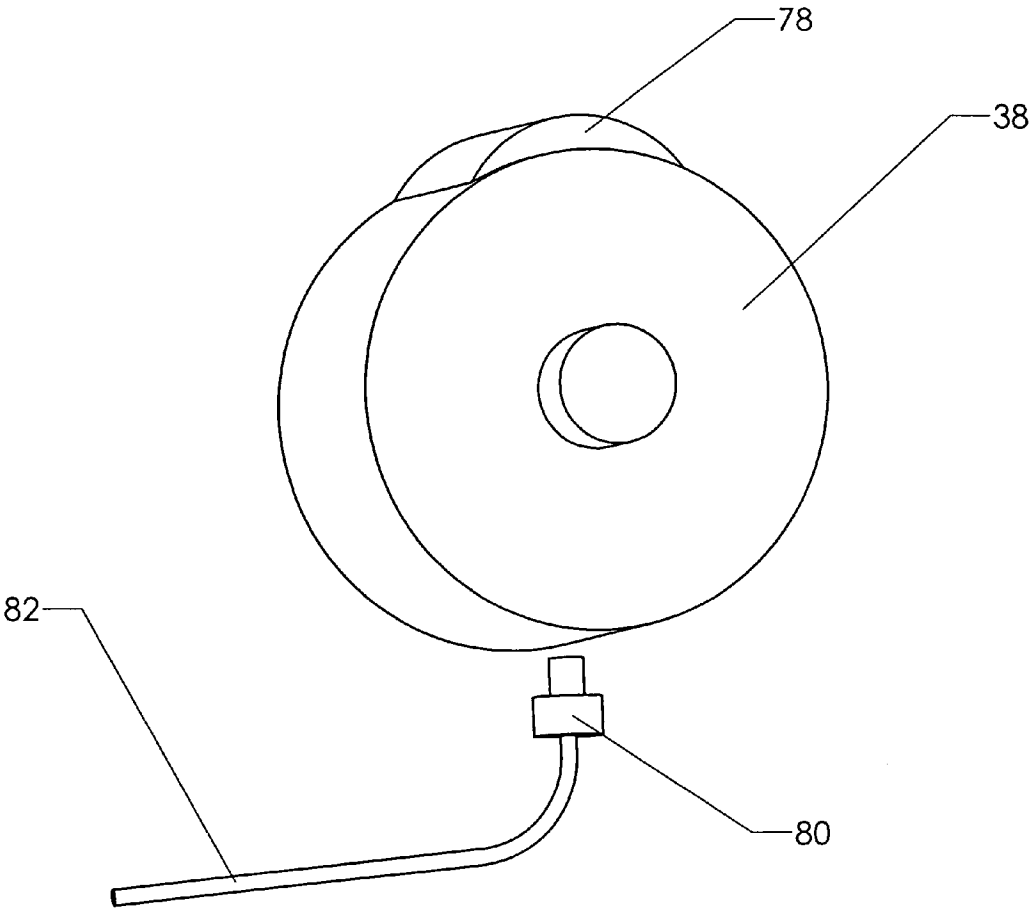
FIG. 6B is a detail view, illustrating components of the present invention.

FIGS. 6A and 6B illustrate yet another sensor configuration for detecting rotation of flywheel 38. In this embodiment, cam 78 is provided on the perimeter of flywheel 38. Contact switch 80 is attached to support structure 66 at a location where cam 78 will close switch 80 when flywheel 38 rotates. FIG. 6A shows the closure of switch 80 when cam 78 contacts switch 80. FIG. 6B shows the opening of switch 80 when cam 78 rotates away from switch 80.

Figure 7:
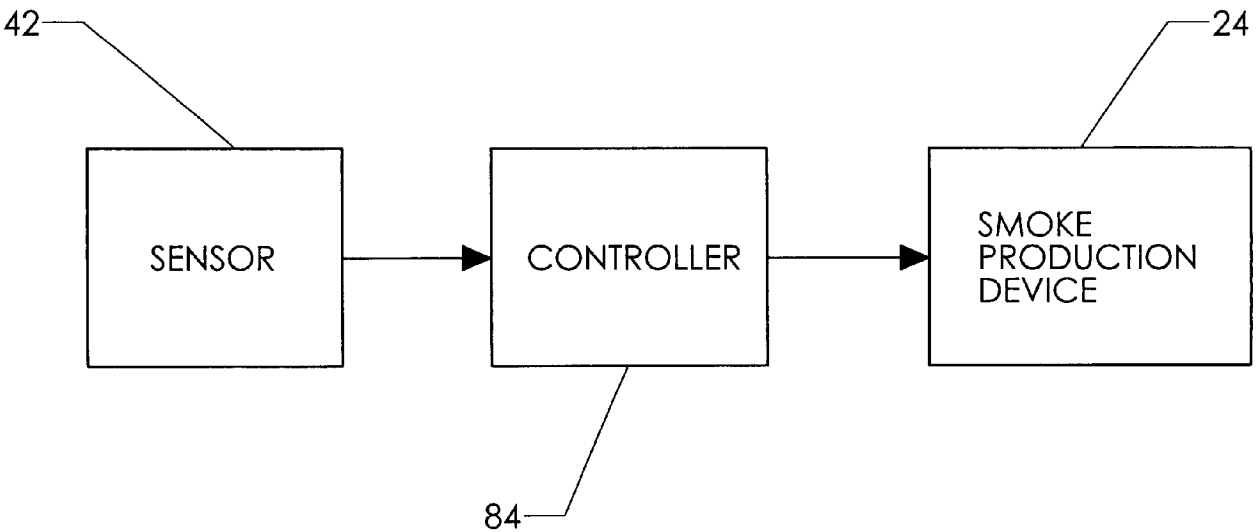
FIG. 7 is a schematic, illustrating operation of the present invention.
Figure 8:
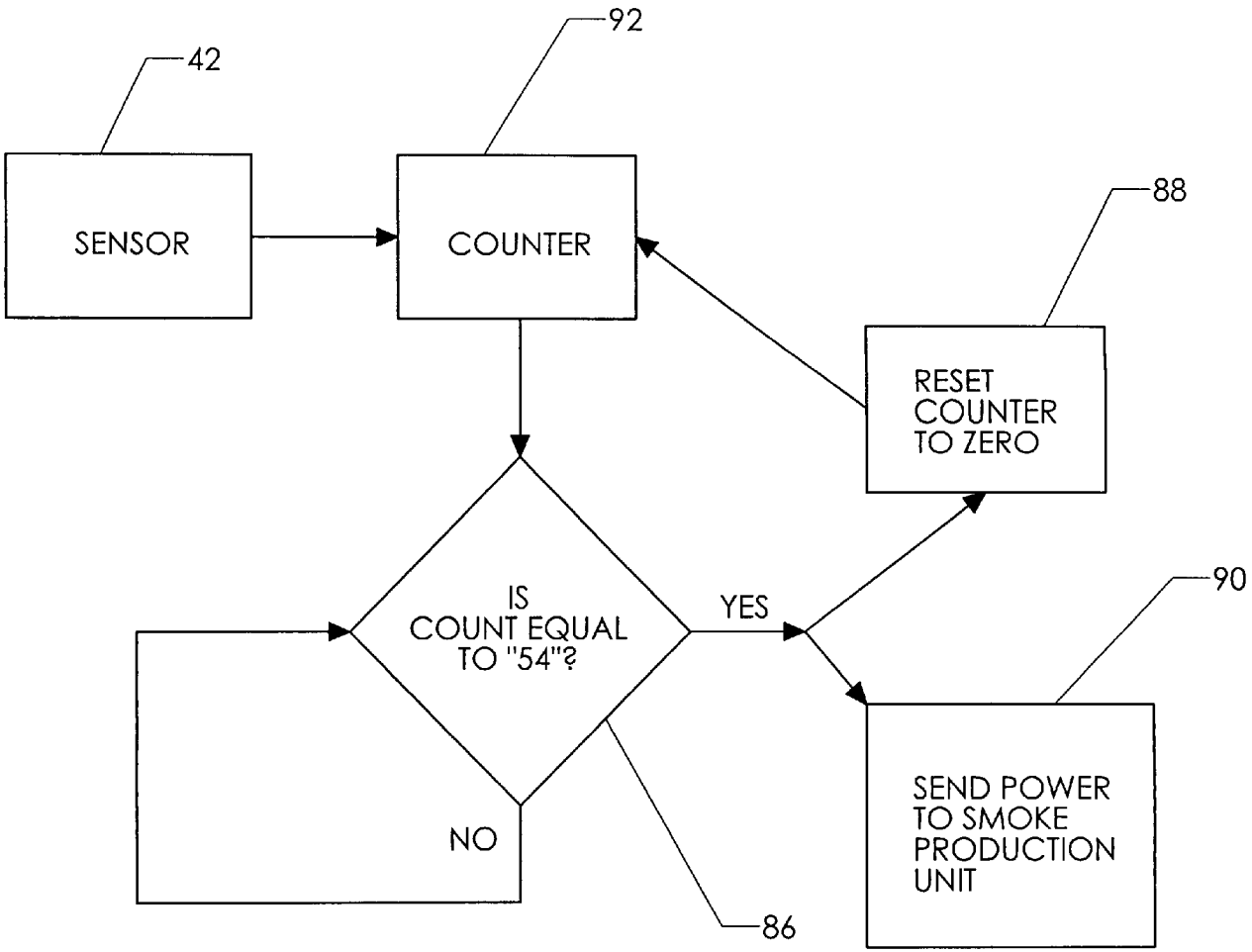
FIG. 8 is a schematic, illustrating operation of the present invention.

For simplicity, the invention will be described as if a reed switch type sensor is used. As shown in FIG. 7, controller 84 receives its input from reed switch 42. In response, controller 84 selectively supplies power to smoke production device 24. Turning to FIG. 8, counter 92 of controller 84 registers every time reed switch 42 closes. The reader will recall that reed switch 42 closes once every time flywheel 38 makes a complete rotation. The reader will also recall that conventional steam locomotives produce four exhaust pulses for every rotation of the train's drive wheel. As such, controller 84 is preferably programmed to supply power to smoke production unit four times per rotation of the model locomotive's drive wheel. Because of the 22:1 gear reduction ratio, this corresponds to one exhaust pulse for every 5.5 rotations of the model locomotive's flywheel.

For simplicity of illustration, the reader will appreciate that emitting one exhaust pulse every 5 rotations of the locomotive's flywheel is a close approximation to the exhaust emission characteristics of a conventional steam-powered locomotive. In fact, the difference in exhaust timing corresponding to the additional delay of 0.5 rotations of the model locomotive's flywheel would be virtually imperceptible to most hobbyists. Nevertheless, the controller could easily be programmed to emit an exhaust pulse every 5.5 rotations of the flywheel.

Every time counter 92 registers a closure of reed switch 42, comparator 86 compares the "count" of counter 92 to see if the count is equal to the value of "5." If it is not, then the process is repeated the next time counter 92 registers a new closure of reed switch 42. When comparator 86 determines that the count is equal to 5, power command 90 is generated and controller 84 supplies power to smoke production device 24. The controller also generates reset command 88 which resets counter 92 to "zero."

Figure 4A:
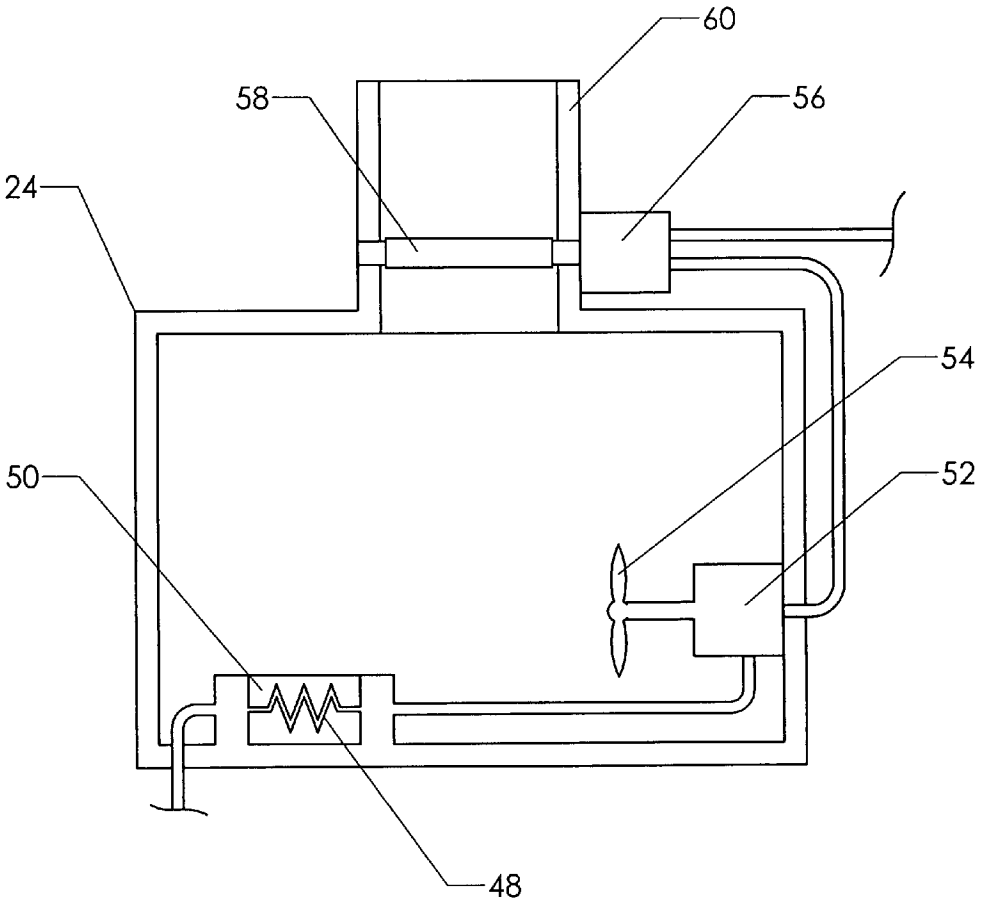
FIG. 4A is a detail view, illustrating a smoke production unit.
Figure 4B:
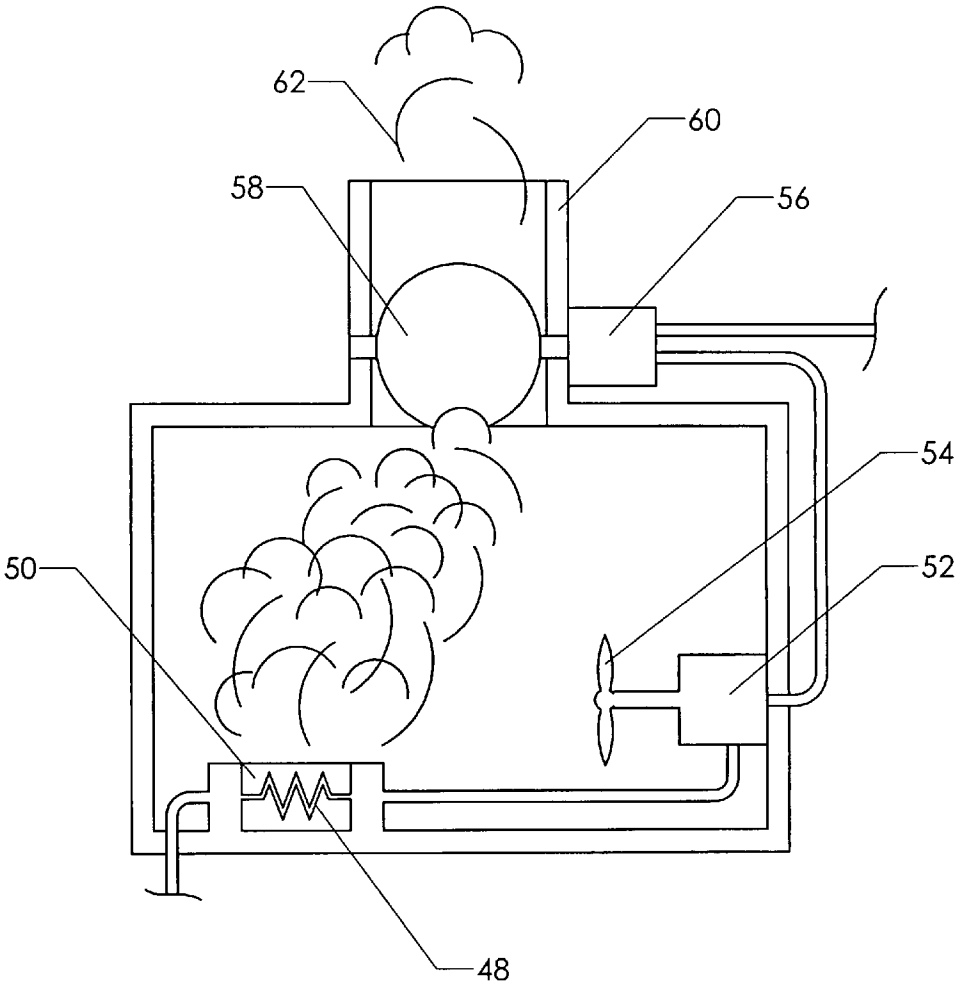
FIG. 4B is a detail view, illustrating a smoke production unit.

FIGS. 4A and 4B illustrate a smoke production device. Smoke production device 24 includes heating element 48 which is in contact with smoking substance 50. Smoking substance 50 may be an oil or any other substance which produces smoke when heated. Fan 54 having fan motor 52 is also positioned inside smoke production device 24. Smoke production device 24 has smokestack 60 which may be opened or closed by the movement of shutter valve 58. FIG. 4A illustrates smoke production device 24 in its normal, nonproducing state.

As shown in FIG. 4B, when power is supplied to smoke production device 24, heating element 48 heats smoking substance 50 causing smoke 62 to be produces inside smoke production device 24. Stepper motor 56 turns causing rotation of shutter valve 58 which allows smoke 62 to exhaust through smoke stack 60. Fan motor 52 rotates fan 54 to evacuate 62 more quickly through smoke stack 60. Thus, the reader will appreciate the power supplied to smoke production device 24 powers heating element, fan motor 52 and stepper motor 56. Although shown connected in series, these devices may also be connected in series or parallel.

The preceding description contains significant detail regarding the novel aspects of the present invention. It should not be construed, however, as limiting the scope of the invention but rather as providing illustrations of the preferred embodiments of the invention. Thus, the scope of the invention should be fixed by the following claims, rather than by the examples given.

Having described my invention, I claim:

1. A model locomotive, comprising:

a. an electric motor;

b. a flywheel attached to said electric motor;

c. a drive wheel mechanically linked to said flywheel;

d. a sensor configured to monitor rotation of said flywheel when placed adjacent thereto;

e. a smoke production unit configured to emit smoke upon receipt of an electric current; and f. a controller electrically connected to said sensor and said smoke production unit, wherein said controller counts rotations of said flywheel and transmits said electric current to said smoke production unit in response thereto.

2. The smoke production system of claim 1, further comprising a magnet attached to said flywheel, wherein said sensor comprises a magnetically-reactive element.

3. The smoke production system of claim 2, wherein said magnetically-reactive element is a reed switch.

4. The smoke production system of claim 2, wherein said magnetically-reactive element is a Hall effect sensor.

5. The smoke production system of claim 1, wherein said sensor comprises an opticoupler.

6. The smoke production system of claim 1, wherein said sensor comprises a cam which rotates in unison with said flywheel and a switch actuated by said cam.

7. The smoke production system of claim 1, wherein said controller transmits said electric current to said smoke production unit four discrete times per rotation of said drive wheel.

8. A model locomotive comprising:

a. an electric motor having a flywheel attached thereto, said flywheel mechanically linked to a drive wheel;

b. a sensor attached to said model locomotive proximal said flywheel, said sensor configured to monitor rotation of said flywheel;

c. a smoke production unit which emits smoke upon receipt of an electric current;

d. a controller electrically connected to said sensor and said smoke production unit, wherein said controller counts rotations of said flywheel and transmits said electric current to said smoke production unit in response thereto.

9. The model locomotive of claim 8, further comprising a magnet attached to said flywheel, wherein said sensor comprises a magnetically-reactive element.

10. The model locomotive of claim 9, wherein said magnetically-reactive element is a reed switch.

11. The model locomotive of claim 9, wherein said magnetically-reactive element is a Hall effect sensor.

12. The model locomotive of claim 8, wherein said sensor comprises an opticoupler.

13. The model locomotive of claim 8, wherein said sensor comprises a cam which rotates in unison with said flywheel and a switch actuated by said cam.

14. The model locomotive of claim 8, wherein said controller transmits said electric current to said smoke production unit four discrete times per rotation of said drive wheel.

* * * * *